US012421835B2

(12) United States Patent
Barron et al.

(10) Patent No.: US 12,421,835 B2
(45) Date of Patent: Sep. 23, 2025

(54) SHIELD FOR ENCLOSURE ASSEMBLY OF A TURBINE AND RELATED METHODS

(71) Applicant: BJ Energy Solutions, LLC, The Woodlands, TX (US)

(72) Inventors: Heber Martinez Barron, The Woodlands, TX (US); Ricardo Rodriguez-Ramon, The Woodlands, TX (US); Tony Yeung, The Woodlands, TX (US)

( * ) Notice: Subject to any disclaimer, the term of this patent is extended or adjusted under 35 U.S.C. 154(b) by 0 days.

(21) Appl. No.: 18/735,890

(22) Filed: Jun. 6, 2024

(65) Prior Publication Data

US 2024/0410263 A1 Dec. 12, 2024

Related U.S. Application Data

(60) Provisional application No. 63/506,506, filed on Jun. 6, 2023.

(51) Int. Cl.

| | |
|---|---|
| ***E21B 43/26*** | (2006.01) |
| ***E21B 41/00*** | (2006.01) |
| ***F41H 5/013*** | (2006.01) |
| ***F41H 5/04*** | (2006.01) |

(52) U.S. Cl.

CPC ..... *E21B 43/26* (2013.01); *E21B 41/0021* (2013.01); *F41H 5/013* (2013.01); *F41H 5/0485* (2013.01)

(58) Field of Classification Search

CPC .. E21B 43/26; E21B 41/0021; E21B 43/2607; F41H 5/013; F41H 5/0485

See application file for complete search history.

(56) References Cited

U.S. PATENT DOCUMENTS

2024/0401452 A1* 12/2024 Bull ..... E21B 43/2607

* cited by examiner

*Primary Examiner* — James G Sayre

(74) *Attorney, Agent, or Firm* — Norton Rose Fulbright US LLP

(57) ABSTRACT

Systems can comprise a prime mover and an enclosure. The enclosure can include a body that comprises walls and one or more anti-ballistic materials. The prime mover can be housed in the body of the enclosure. For at least one of the walls of the body of the enclosure, at least one of the anti-ballistic material(s) can be attached to an inner surface of the wall. Each of the anti-ballistic material(s) may be in the form of a woven fabric comprising para-aramid fibers. In some examples, for each of the pumping unit(s), the walls of the enclosure's body include opposing first and second sidewalls; and opposing front and rear walls, each extending from the first sidewall to the second sidewall; wherein for each of the first and second sidewalls and front and rear walls, at least one of the anti-ballistic material(s) is attached to the inner surface of the wall.

20 Claims, 12 Drawing Sheets

SHIELD FOR ENCLOSURE ASSEMBLY OF A TURBINE AND RELATED METHODS

CROSS-REFERENCE TO RELATED APPLICATIONS

This application claims the benefit of U.S. Provisional Patent Application No. 63/506,506 to Barron et al., entitled "SHIELD FOR ENCLOSURE ASSEMBLY OF A TURBINE AND RELATED METHODS," and filed on Jun. 6, 2023, which is hereby incorporated by reference herein.

FIELD OF INVENTION

This disclosure relates to systems and methods for increasing the safety of a prime mover such as a gas turbine engine used in, for example, hydraulic fracturing or electrical power generation.

BACKGROUND

Prime movers like gas turbine engines are used in various industries, including but not limited to hydraulic fracturing and electrical power generation. However, operating these engines comes with certain safety concerns, especially in environments where catastrophic failures can occur. Such failures can result in the fracture and detachment of components within the prime mover, posing a significant risk to workers in the field.

In industries, such as hydraulic fracturing, where gas turbine engines are often employed to power drilling equipment and other machinery, the need for enhanced safety measures is paramount. The intense vibrations, high temperatures, and extreme operating conditions experienced by these engines can lead to the failure of critical components (e.g., turbine or compressor blades), causing them to break apart and become dangerous projectiles.

The potential release of these projectiles poses a severe threat to the safety of personnel and equipment in the vicinity of the prime mover. The projectiles can travel under considerable speed and over considerable distances, and can accordingly cause serious injuries and significant damage to surrounding structures and machinery. Addressing this safety concern is important to ensure the well-being of personnel working in close proximity to the prime movers.

Furthermore, prime movers like gas turbine engines can produce a significant amount of noise, which can be disruptive both for personnel working on site and for individuals in the area surrounding the site.

Accordingly, the inventors have recognized that a need exists for mitigating the risks associated with catastrophic failures of prime movers like gas turbine engines, and also to attenuate the sound produced by prime movers. The inventors have also recognized a need for a robust solution that can effectively contain and prevent the projection of fragments from prime movers like gas turbine engines, particularly those used in mobile power generation and hydraulic fracturing. The present disclosure addresses these and other related and unrelated problems in the art.

SUMMARY

Embodiments of the present disclosure can mitigate the risks associated with catastrophic failures of prime movers and/or attenuate the sound produced by prime movers through the use of an enclosure that can house a prime mover. In some embodiments, the enclosure can comprise one or more anti-ballistic materials to promote safety. In such embodiments, for at least one of the walls of the body of the enclosure, at least one of the anti-ballistic material(s) can be attached to the wall, preferably to the wall's inner surface. The anti-ballistic material(s), working in conjunction with the walls of the body of the enclosure, can help contain debris projected outward by the prime mover in the event of a catastrophic failure and can thereby improve safety. The anti-ballistic material(s) preferably comprise a woven fabric that includes fibers such as para-aramid fibers that can effectively catch debris from the prime mover.

To attenuate the sound produced by the prime mover, in some embodiments at least one—or up to and including each—of the walls of the body of the enclosure can have a multi-layered construction that can help deaden the sound produced by the prime mover (and, optionally, other drive equipment housed by the enclosure). For example, at least one—or up to and including each—of the walls can have outer and inner metallic layers (e.g., comprising aluminum that, optionally, is perforated) and a foam layer and/or a composite layer (e.g., comprising mineral wool) disposed between the metallic layers. The metallic layers can provide structural support, and the foam layer and/or composite layer can promote the attenuation of sound produced within the body of the enclosure.

Some of the embodiments comprise a prime mover. The prime mover, in some systems, is configured to drive a hydraulic fracturing pump or an electric power generator. Some systems comprise an enclosure.

Some of the embodiments of the hydraulic fracturing systems comprise one or more pumping units. In some hydraulic fracturing systems, each of the pumping unit(s) comprises a hydraulic fracturing pump and a prime mover configured to drive the hydraulic fracturing pump. In some hydraulic fracturing systems, each of the pumping unit(s) comprises an enclosure.

In some embodiments, the enclosure includes a body that comprises walls. The enclosure, in some embodiments, comprises one or more anti-ballistic materials. In some embodiments, the prime mover is housed in the body of the enclosure. In some embodiments, for at least one of the walls of the body of the enclosure, at least one of the anti-ballistic material(s) is attached to an inner surface of the wall.

In some embodiments, each of the anti-ballistic material (s) is in the form of a woven fabric. The woven fabric, in some embodiments, comprises para-aramid fibers.

In some embodiments, the walls of the body of the enclosure include opposing first and second sidewalls and opposing front and rear walls, each extending from the first sidewall to the second sidewall. In some embodiments, for each of the first and second sidewalls and front and rear walls, at least one of the anti-ballistic material(s) is attached to the inner surface of the wall. The first and second sidewalls and front and rear walls, in some embodiments, each comprise a metal. In some embodiments, the first and second sidewalls and front and rear walls each include multiple layers, the layers including inner and outer metallic layers and a foam layer and/or a mineral wool layer that are each disposed between the inner and outer metallic layers. In some embodiments, the first and second sidewalls and front and rear walls each have a thickness that is between 4.5 and 5.25 inches.

In some embodiments, the prime mover comprises a gas turbine engine. In some hydraulic fracturing systems, the gas turbine engine is in fluid communication with at least one fuel supply. Some systems comprise a gearbox, and in some hydraulic fracturing systems each of the pumping unit(s)

comprises a gearbox. In some embodiments, the gearbox is operatively connected to the prime mover. The gearbox, in some embodiments, is housed in the body of the enclosure. In some embodiments, the hydraulic fracturing pump or electric power generator is disposed outside of the body of the enclosure and is operatively connected to the gearbox via a driveshaft.

In some embodiments, for each of the anti-ballistic material(s) that is attached to the inner surface of at least one of the walls of the body of the enclosure, a distance between the anti-ballistic material and the inner surface to which the anti-ballistic material is attached is at least 1 millimeter. In some embodiments, for each of the anti-ballistic material(s) that is attached to the inner surface of at least one of the walls of the body of the enclosure, the anti-ballistic material is attached to the inner surface via a plurality of fasteners. In some embodiments, for each of the fasteners the system or pumping unit includes a spacer that the fastener extends through and is disposed between the anti-ballistic material and the inner surface to which the anti-ballistic material is attached. In some embodiments, for each of the anti-ballistic material(s) that is attached to the inner surface of at least one of the walls of the body of the enclosure, the anti-ballistic material has opposing upper and lower edges and a height measured between the upper and lower edges. In some of such embodiments, the fasteners include a first set of fasteners, wherein for each of the fasteners of the first set, a distance between the fastener and the upper edge of the anti-ballistic material is within 10% of the height of the anti-ballistic material. In some of such embodiments, the fasteners include a second set of fasteners, wherein for each of the fasteners of the second set, a distance between the fastener and the lower edge of the anti-ballistic material is within 10% of the height of the anti-ballistic material.

Some systems comprise a trailer, and in some hydraulic fracturing systems, each of the pumping unit(s) comprises a trailer. The enclosure and the prime mover, in some embodiments are disposed on the trailer. In some embodiments, the hydraulic fracturing pump or electric power generator are disposed on the trailer. The trailer, in some embodiments, comprises one or more pairs of wheels. In some embodiments, the trailer comprises a coupler configured to be coupled to a truck.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified—and includes what is specified, e.g., substantially 90 degrees includes 90 degrees and substantially parallel includes parallel—as understood by a person of ordinary skill in the art. As used herein, "substantially parallel" means within 10 degrees of parallel to, and "substantially perpendicular" means within 10 degrees of perpendicular to. In any disclosed embodiment, the term "about" may be substituted with "within [a percentage] of" what is specified, where the percentage includes 0.1, 1, 5, and 10 percent."

The terms "comprise" and any form thereof such as "comprises" and "comprising," "have" and any form thereof such as "has" and "having," and "include" and any form thereof such as "includes" and "including" are open-ended linking verbs. As a result, an apparatus or system that "comprises," "has," or "includes" one or more elements possesses those one or more elements but is not limited to possessing only those elements. Likewise, a method that "comprises," "has," or "includes" one or more steps possesses those one or more steps but is not limited to possessing only those one or more steps.

Any embodiment of any of the apparatuses, systems, and methods can consist of or consist essentially of—rather than comprise/have/include—any of the described steps, elements, and/or features. Thus, in any of the claims, the term "consisting of" or "consisting essentially of" can be substituted for any of the open-ended linking verbs recited above in order to change the scope of a given claim from what it would otherwise be using the open-ended linking verb.

Further, an apparatus or system that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Embodiments of the present disclosure can include an enclosure assembly to enhance the safety of a drive unit (e.g., a direct drive unit (DDU)) that comprises a prime mover such as a gas turbine engine when the drive unit is used in, for example, hydraulic fracturing or electric power generation. Embodiments of the present disclosure including such enclosure assemblies may be particularly well-suited for enhancing the safety of DDUs associated with high-pressure, high-power hydraulic fracturing operations.

Figure 1A:
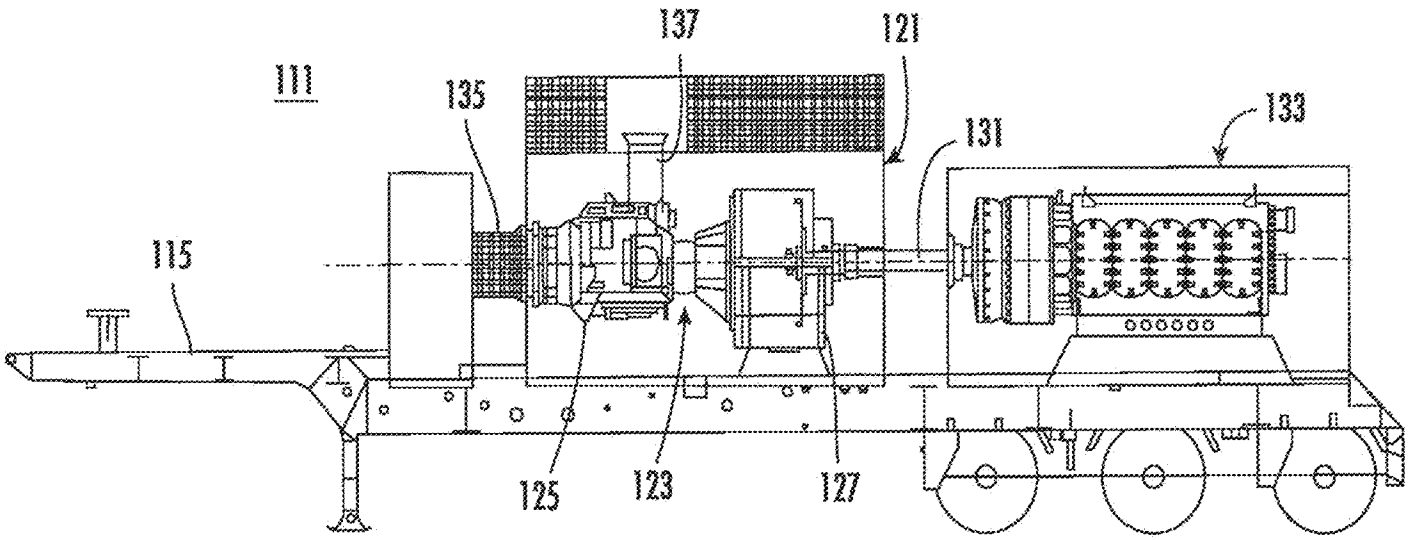
FIG. 1A is a schematic diagram of a first embodiment of the present systems that is a pumping unit.

Referring to FIG. 1A, illustrated is one of the present systems 111 that can comprise an enclosure assembly 121 for housing a prime mover 125 such as a turbine engine. As shown, system 111 can be a pumping unit that comprises a pump 133—such as a hydraulic fracturing pump, which can be a high-pressure, high-power, reciprocating positive displacement pump—that the prime mover can be configured to drive such that the pumping unit can be used in, for example, hydraulic fracturing operations. While system 111 can be a pumping unit with a hydraulic fracturing pump 133, in other embodiments the system can be another type of unit within, for example, the well stimulation industry, such as a blender unit, a cementing unit, a power generation unit, and/or the like. For example, when system 111 is a power generation unit, it can comprise—instead of hydraulic fracturing pump 133—an electric power generator (e.g., an alternator) that prime mover 125 can be configured to drive and that can be configured to generate electricity when driven by the prime mover.

Prime mover 125 can be configured to output a relatively high amount of power, which can render it well-suited for hydraulic fracturing and power generation operations. For example, prime mover 125 can be configured to output greater than or equal to any one of, or between any two of, 1,000, 1,250, 1,500, 1,750, 2,000, 2,250, 2,500, 2,750, or 3,000 horsepower (e.g., at which the prime mover can drive, for example, pump 133 or an electric power generator). Furthermore, multiples ones of systems 111 can be used together to collectively output more power.

Figure 1B:
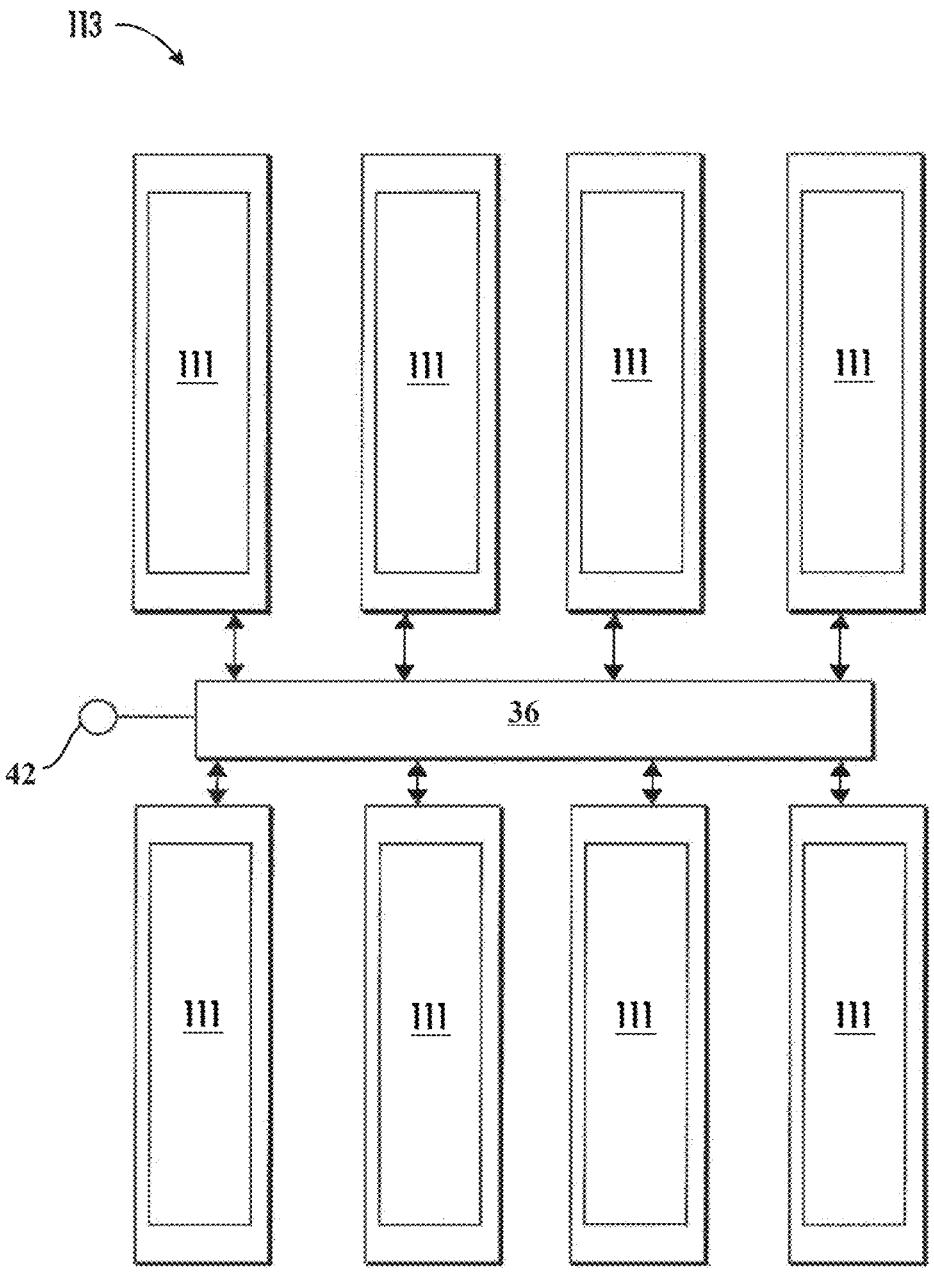
FIG. 1B is a schematic diagram of a layout of a fluid pumping system according to an embodiment of the disclosure.

As an illustration, and referring additionally to FIG. 1B, one or more pumping units 111—such as greater than or equal to any one of, or between any two of, one, two, three, four, five, six, seven, or eight pumping units—can be used in a high-pressure, high power, fluid pumping system 113 for use in hydraulic fracturing operations according to an embodiment of the disclosure. As described in further detail below, pumping unit(s) 111 can each be operatively connected to a manifold 36 that is operatively connected to a wellhead 42 for hydraulic fracturing.

System 113 may be sized to achieve a maximum rated horsepower of 24,000 HP for the pumping system, such as by including eight (8) 3000 horsepower pumping units 111 that may be used in one embodiment of the disclosure. It will be understood that the fluid pumping system 113 may include associated service equipment such as hoses, connections, and assemblies, among other devices and tools.

As shown in FIG. 1A, system 111's prime mover (e.g., gas turbine engine) can be part of a drive unit 123 (e.g., a direct drive unit (DDU)) that can comprise a gearbox 127 or other mechanical transmission and can also be housed in enclosure assembly 121. Gearbox 127 can be an interface through which power from prime mover 125 is transmitted to the equipment to be driven by the prime mover, such as hydraulic fracturing pump 133 or an electric power generator. For example, prime mover 125 can be operatively connected to gearbox 127, pumping unit 111 can have a driveshaft 131 operatively connected to the gearbox, and the equipment to be driven by the prime mover (e.g., pump 133 or an electric power generator) can be operatively connected to the drive unit 123 (e.g., its gearbox) via the driveshaft.

System 111 can comprise a trailer 115 on which enclosure assembly 121, drive unit 123 (including prime mover 125 and gearbox 127), and the equipment to be driven by the prime mover (e.g., pump 133 or an electric power generator) can be disposed for transport and positioning at a jobsite. Trailer 115 can include other associated components such as, when prime mover 125 is a gas turbine engine, a turbine exhaust duct 135 operatively connected to the gas turbine engine, air intake duct 137 operatively connected to the gas turbine engine, and other associated equipment hoses, connections, and/or the like to facilitate operation of system 111.

In the illustrated embodiment, prime mover 125 may be a Vericor Model TF50F bi-fuel turbine; however, drive unit 123 may include other gas turbines or prime movers, systems, and/or mechanisms suitable for use as, for example, a hydraulic fracturing pump drive or an electric power generator drive without departing from the disclosure. In one embodiment, prime mover 125 may comprise a turbine engine that uses diesel or other fuel as a power source. Prime mover 125 can be cantilever mounted to gearbox 127, with the gearbox supported by the floor of enclosure assembly 121.

Figure 2:
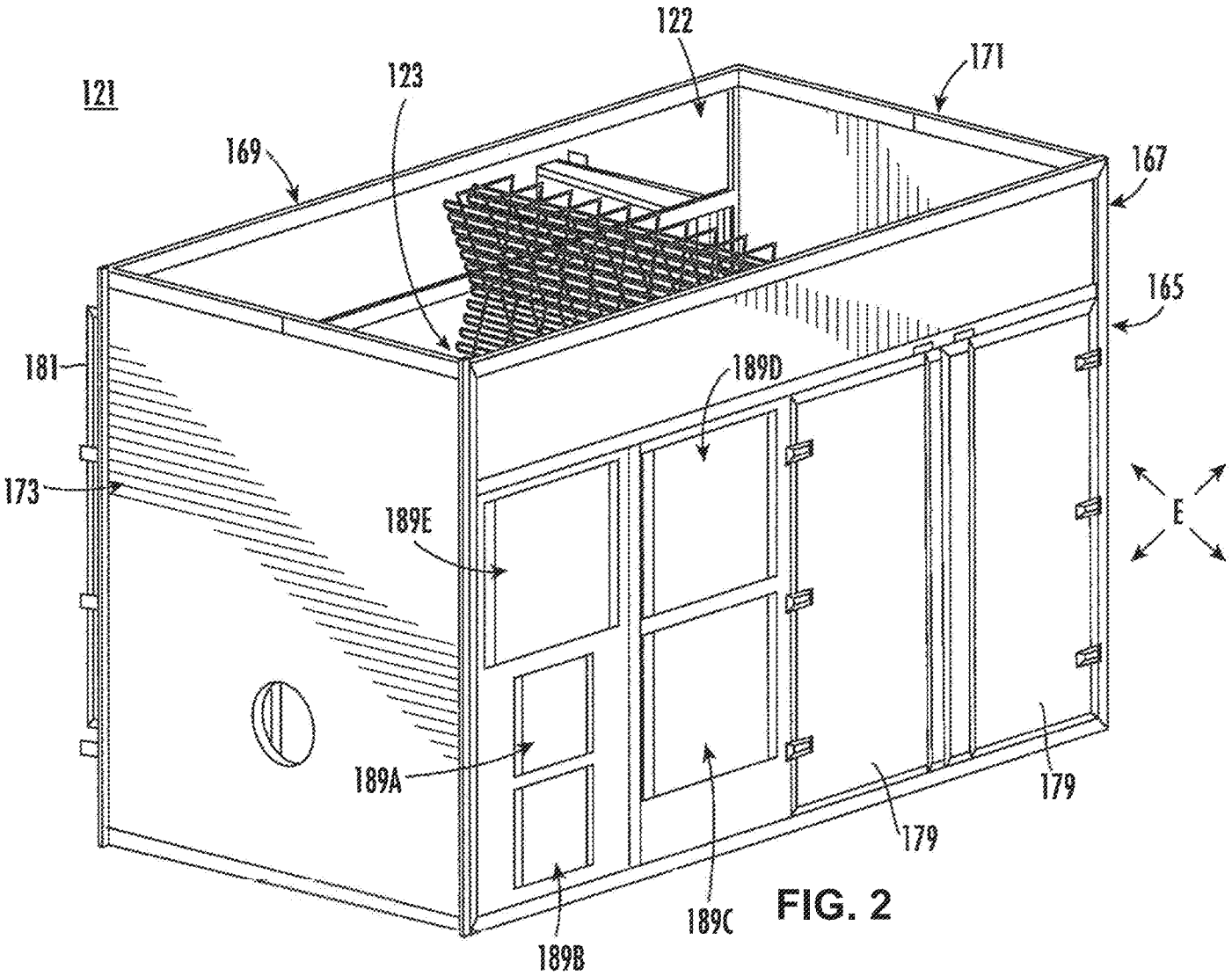
FIG. 2 is a perspective view of an enclosure assembly according to an embodiment of the disclosure.
Figure 4:
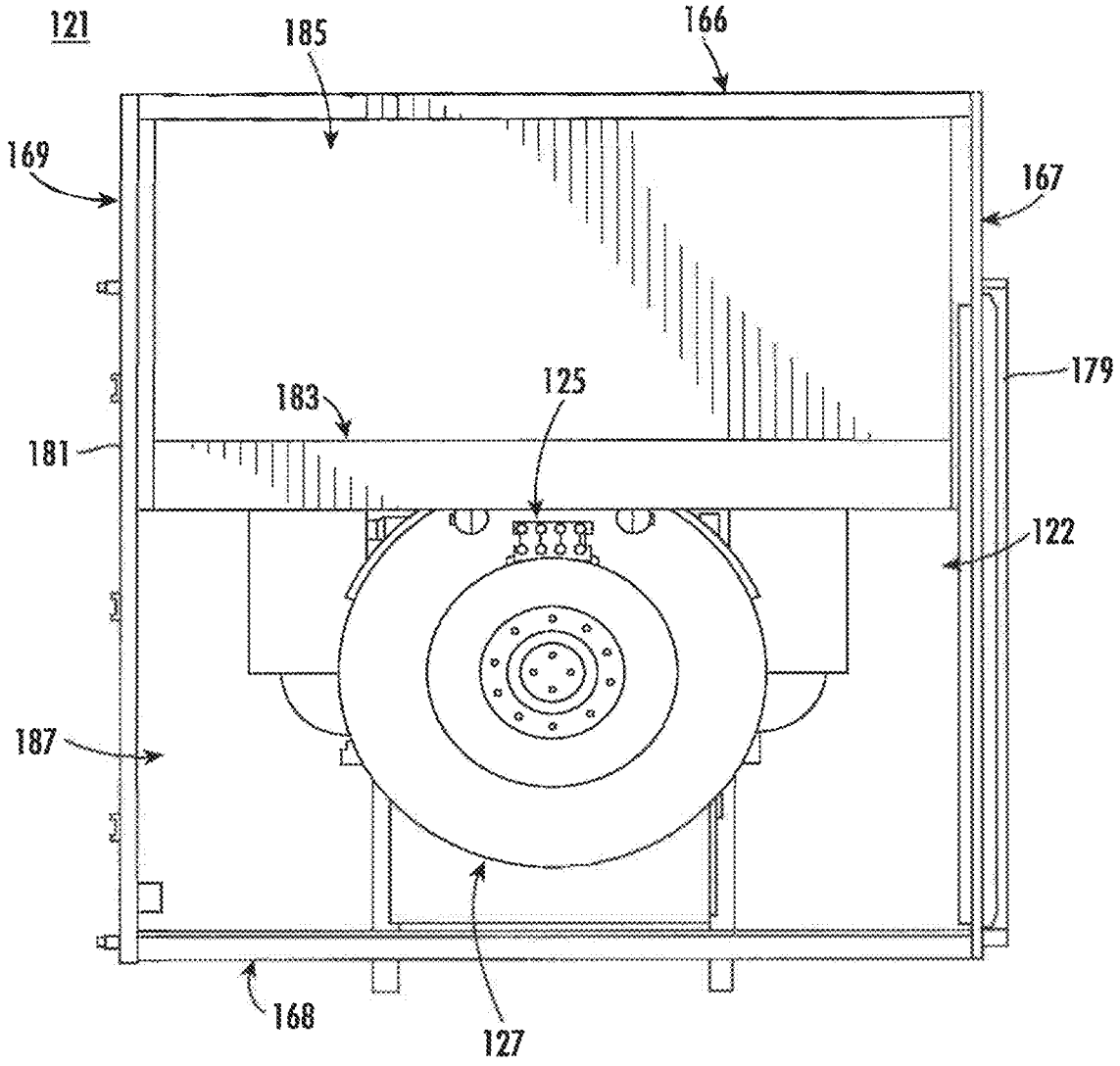
FIG. 4 is a schematic sectional view of an enclosure assembly according to an embodiment of the disclosure.

Referring additionally to FIGS. 2 and 4, illustrated is an enclosure assembly 121 that can be part of system 111 and can house drive unit 123 (e.g., prime mover 125 and, optionally, gearbox 127) according to an exemplary embodiment of the disclosure. As shown, enclosure assembly 121 can include an enclosure body 165 that may extend at least partially around an enclosure space 122 to house one or more portions of drive unit 123 therein, such as prime mover 125 and, optionally, gearbox 127. Enclosure space 122 may also be sized and configured to accommodate other drive unit/engine equipment, for example, a driveshaft interface, fuel trains, an exhaust system flanged connection, a fire suppression system, bulkheads, exhaust ducting, engine air intake ducting, hydraulic/pneumatic bulkhead hoses, inspection doors/hatches, and/or the like.

Enclosure body 165 can comprise a plurality of walls, which in one embodiment may be in a box-like or cuboid arrangement. For example, enclosure body 165 can comprise a first side wall 167, a second side wall 169 opposite the first side wall, and opposing front wall 171 and rear wall 173 that each extend from the first side wall to the second side wall. Enclosure body 165 may also include a roof/top wall 166 and a floor/bottom wall 168. In one embodiment, floor 168 may be formed of a solid base steel material mounted on a skid structure.

Figure 3:
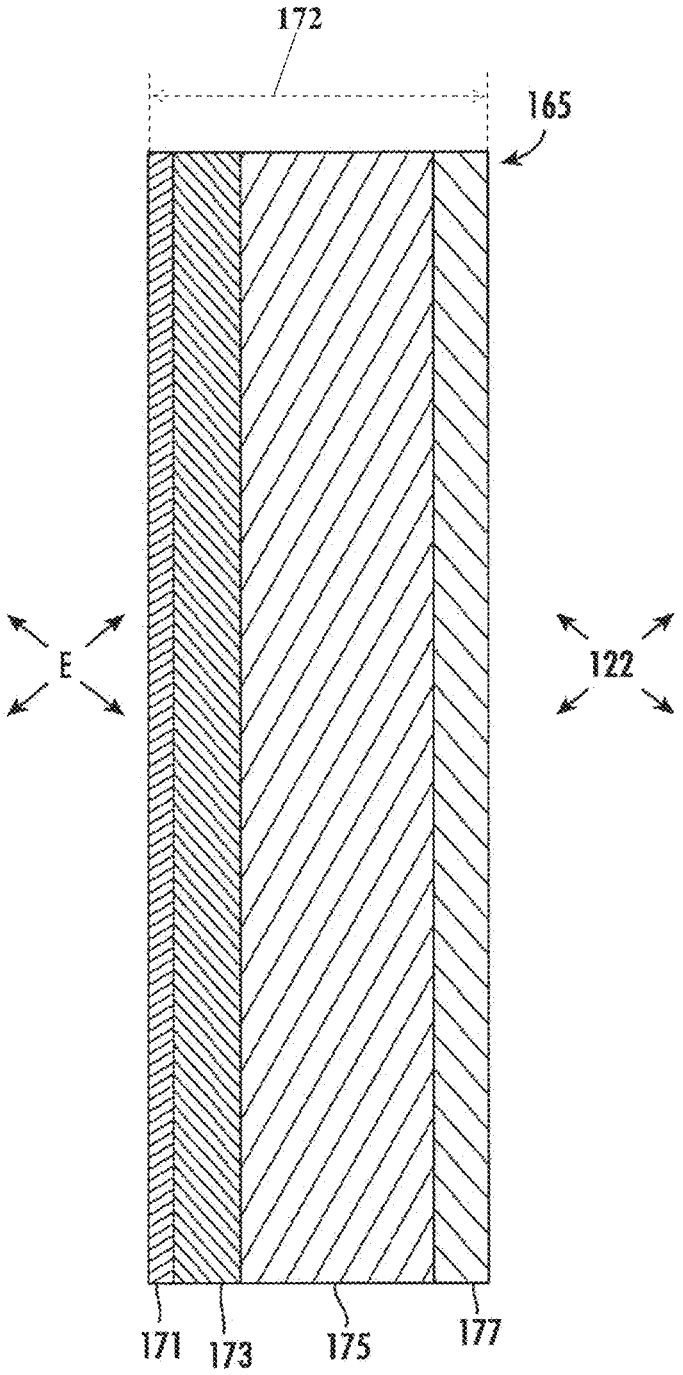
FIG. 3 is a schematic sectional view of an enclosure body according to an embodiment of the disclosure.

Referring additionally to FIG. 3, one or more—up to and including each—of walls 167, 169, 171, 173 of enclosure body 165 can comprise a metal and, optionally, one or more materials with sound-attenuating, e.g., vibration-dampening, properties to minimize the transmission of sound from one or more operations of the drive unit 123, e.g., running of prime mover 125 and/or gearbox 127, from enclosure space 122 to an external environment surrounding the enclosure body. In this regard, one or more—up to and including each—of walls 167, 619, 171, 173 of enclosure body 165 may have a configuration in which multiple layers are arranged to provide sound attenuation.

To illustrate, in one embodiment, at least one—up to and including each—of walls 167, 169, 171, 173 of enclosure body 165 may include an outer metallic layer 171, an inner or liner metallic layer 177, and a foam or other polymeric layer 173 and/or a composite layer 175, with the foam layer and/or composite layer positioned between the metallic layers. Outer and inner metallic layers 171 and 177 can each comprise, for example, aluminum that optionally is perforated, and composite layer 175 can comprise, for example, mineral wool. An overall thickness 172 of each of walls 167, 169, 171, 173 of enclosure body 165 can be greater than or equal to any one of, or between any two of, 3.0, 3.25, 3.50, 3.75, 4.0, 4.25, 4.5, 4.75, 5.0, 5.25, 5.50, 5.75, or 6.0 inches, such as from about 4.5 inches to about 5.25 inches, which can promote the wall's sound-attenuating capabilities. For example, outer and inner metallic layers 171 and 177 can each have a thickness that is greater than or equal to any one of, or between any two of, 30, 28, 26, 24, 22, 20, 18, or 16 gauge (e.g., 22 gauge), foam layer 173 can have a thickness that is greater than or equal to any one of, or between any two of, 0.5, 0.6, 0.7, 0.8, 0.9, 1.0, 1.1, 1.2, 1.3, 1.4, or 1.5 inches, and/or composite layer 175 (e.g., the mineral wool layer) can have a thickness that is greater than or equal to any one of, or between any two of, 2.5, 2.75, 3.0, 3.25, 3.5, 3.75, 4.0, 4.25, or 4.5 inches (e.g., between 3 and 4 inches).

Figure 5:
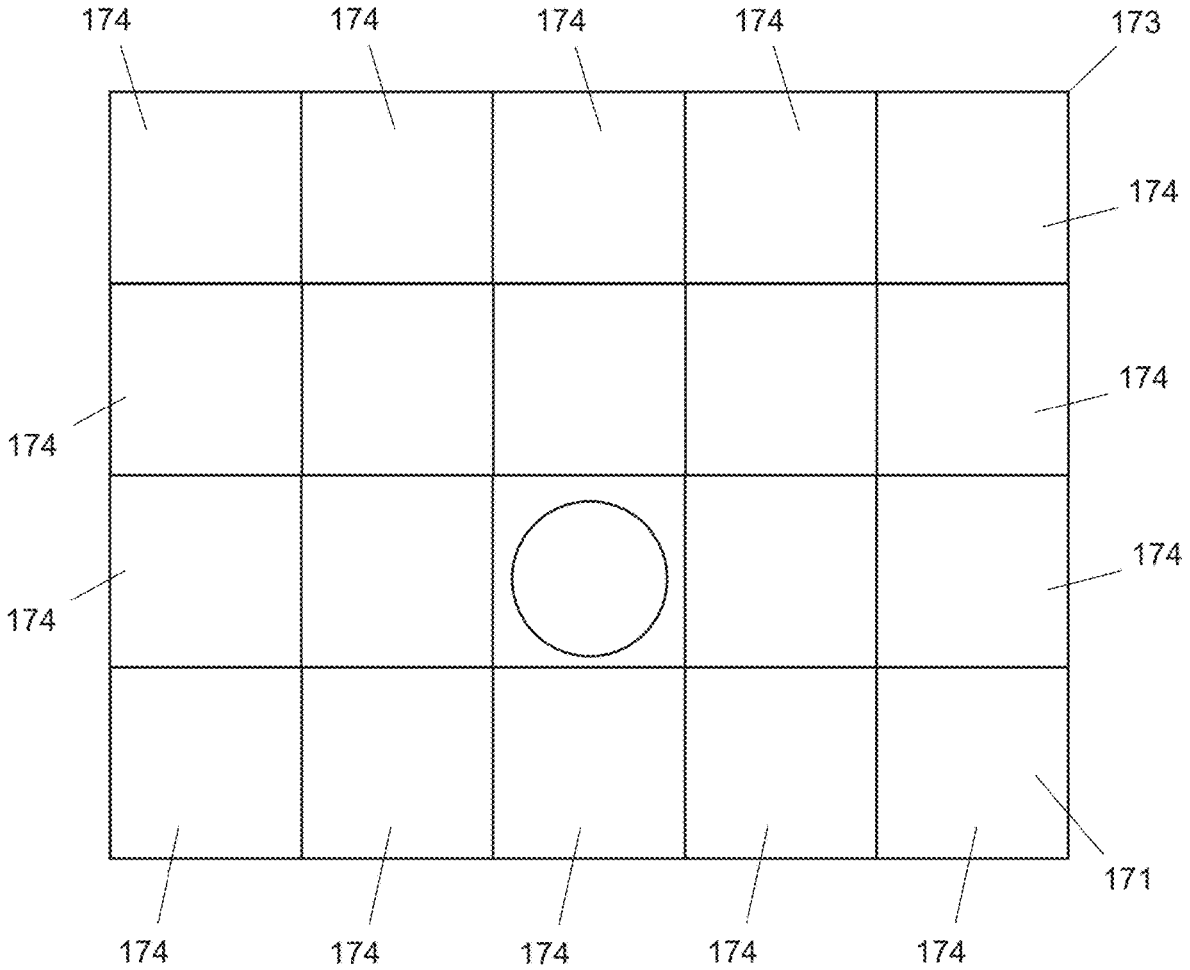
FIG. 5 is a schematic rear view of an enclosure assembly according to an embodiment of the disclosure where one or more of the walls of the enclosure assembly's body comprises a plurality of panels.

Referring additionally to FIG. 5, in some embodiments walls 167, 169, 171, 173 can each comprise a plurality of panels 174 that may clip, snap, or otherwise connect together in a generally modular arrangement. Each of the panels 174 of each of walls 167, 169, 171, 173 can have the above-described multi-layered arrangement (e.g., with outer and inner metallic layers and a foam and/or composite layer disposed between the outer and inner metallic layers) such that the panels can collectively define outer metallic layer 171, inner metallic layer 177, and foam layer 173 and/or composite layer 175 of the wall. For example, each of panels 174 can have an outer 22 ga perforated aluminum sheet, a foam layer that may be, for example, a 1" foam layer, a composite layer that may be, for example, a 3"-4" layer of mineral wool, and an inner metallic layer that may be, for example, perforated 22 ga aluminum. Panels 174 can each have a width and a length that facilitate modularity, such as a width and a length that are each less than or equal to any one of, or between any two of, 36, 34, 32, 30, 28, 26, 24, 23, 22, 20, 18, 16, 14, 12, or 10 inches (e.g., about 12 inches).

Roof 166 of enclosure body 165 may have a similar multi-layered arrangement as each of walls 167, 169, 171, 173 (e.g., comprising outer and inner metallic layers and a foam layer and/or a composite layer disposed between the outer and inner metallic layers), with an overall thickness of, for example, greater than or equal to any one of, or between any two of, 1.0, 1.25, 1.5, 1.75, 2.0, 2.25, 2.5, 2.75, or 3 inches (e.g., about 2 inches). If roof 166 includes a foam layer, the foam layer can have a thickness that is greater than or equal to any one of, or between any two of, 0.5, 0.75, 1.0, 1.25, 1.5, 1.75, 2.0, 2.25, or 2.5 inches (e.g., about 1.5 inches). Enclosure body 165 may have a different arrangement without departing from the disclosure.

System 111 can have other sound-attenuating features. For example, gearbox 127 can have shock-absorbing feet or mounts that minimize the transmission of vibrations to enclosure body 165.

As shown in FIG. 2, enclosure assembly 121 can comprise a plurality of doors 179, 181, 189A-189E that may each be movably connected/attached to enclosure body 165, e.g., to provide access to enclosure space 122 for inspections, maintenance, and/or the like. A pair of doors 179 may be hingably connected/attached to first side wall 167 of the enclosure body 165 to provide access to enclosure space 122 through openings formed in the first side wall 167 upon movement of the doors.

A door 181 may also be movably connected to second side wall 169 of enclosure body 165 to provide access to enclosure space 122 along the second side wall. In one embodiment, door 181 may be slidably connected/attached to second side wall 169 on rails, tracks, and/or the like, such that slidable movement of the door exposes an opening in the second side wall through which an operator may access the enclosure space 122. In one embodiment, door 181 may have one or more foldable or otherwise reconfigurable portions.

With additional reference to FIG. 4, a generally horizontal partition 183 may extend in general parallel relation with roof 166 and floor 168 of enclosure body 165 (e.g., such that the horizontal partition is substantially parallel to each of the roof and floor) so as to provide an upper compartment 185 and a lower compartment 187 of enclosure space 122. In one embodiment, upper compartment 185 may include an air intake assembly that may include an arrangement of ducts, fans, ports, filtration assemblies, blowers, compressors, cooling coils, and/or the like to feed filtered air into turbine engine 123 positioned in lower compartment 187.

In view of the foregoing, enclosure assembly 121 may be provided with a generally weatherproof or weather-resistant configuration that is sufficiently robust for use in, for example, hydraulic fracturing or power generation applications, and which additionally can provide sound attenuation properties for enclosed and associated equipment. For example, enclosure assembly 121 may provide sufficient sound attenuation emanating from one or more incorporated heat exchanger assemblies, as described further herein.

During various operations of system 111, e.g., startup and shutdown procedures, idling, maintenance cycles, active driving of pump 133 or an electric power generator, and/or the like, heat may be generated in one or more portions of the system, for example, via frictional engagement of components of the pump such as pistons, bores, and/or the like.

Figure 6:
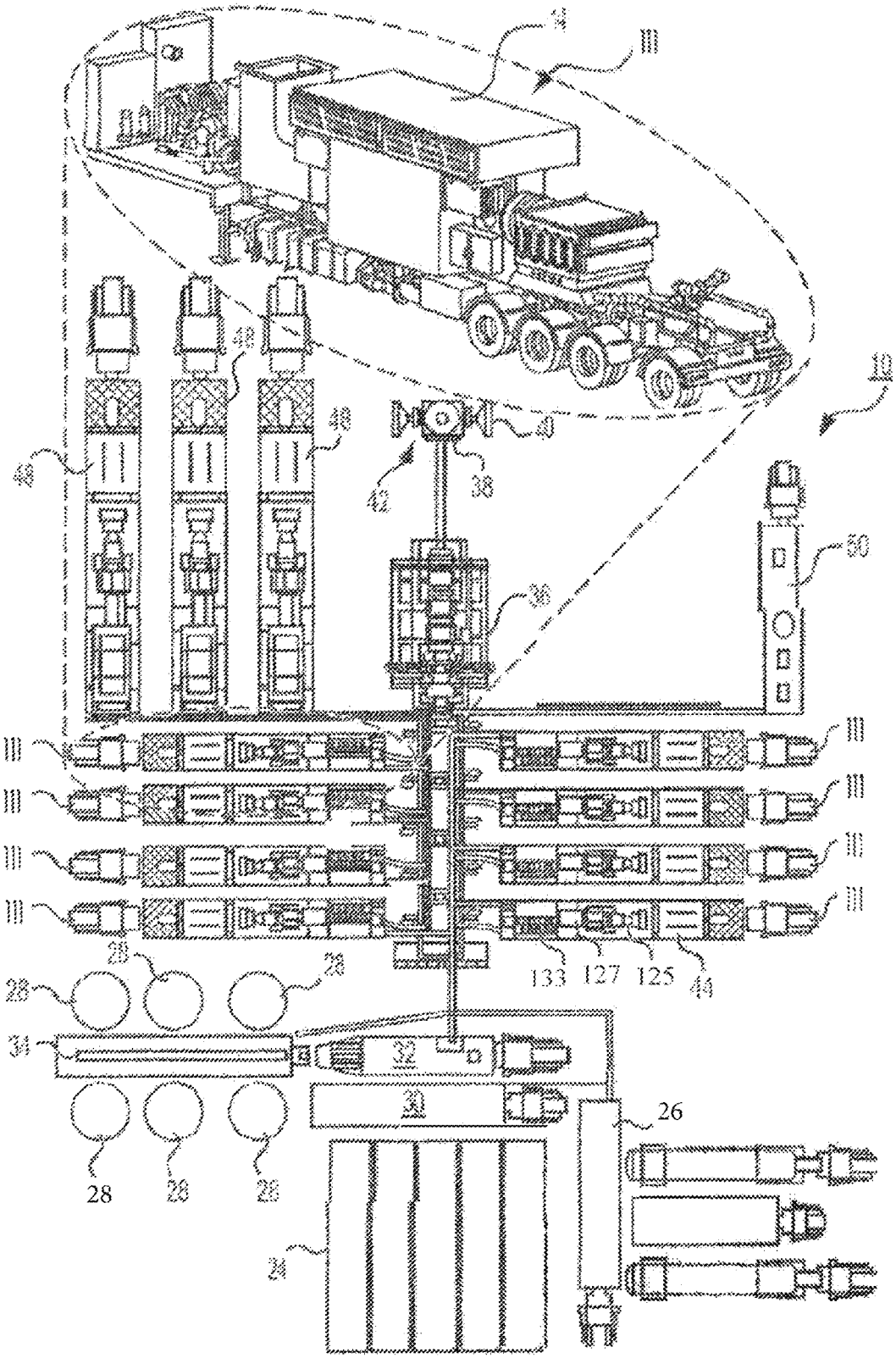
FIG. 6 schematically illustrates an example hydraulic fracturing system including a plurality of example pumping units, according to an embodiment of the disclosure.
Figure 7:
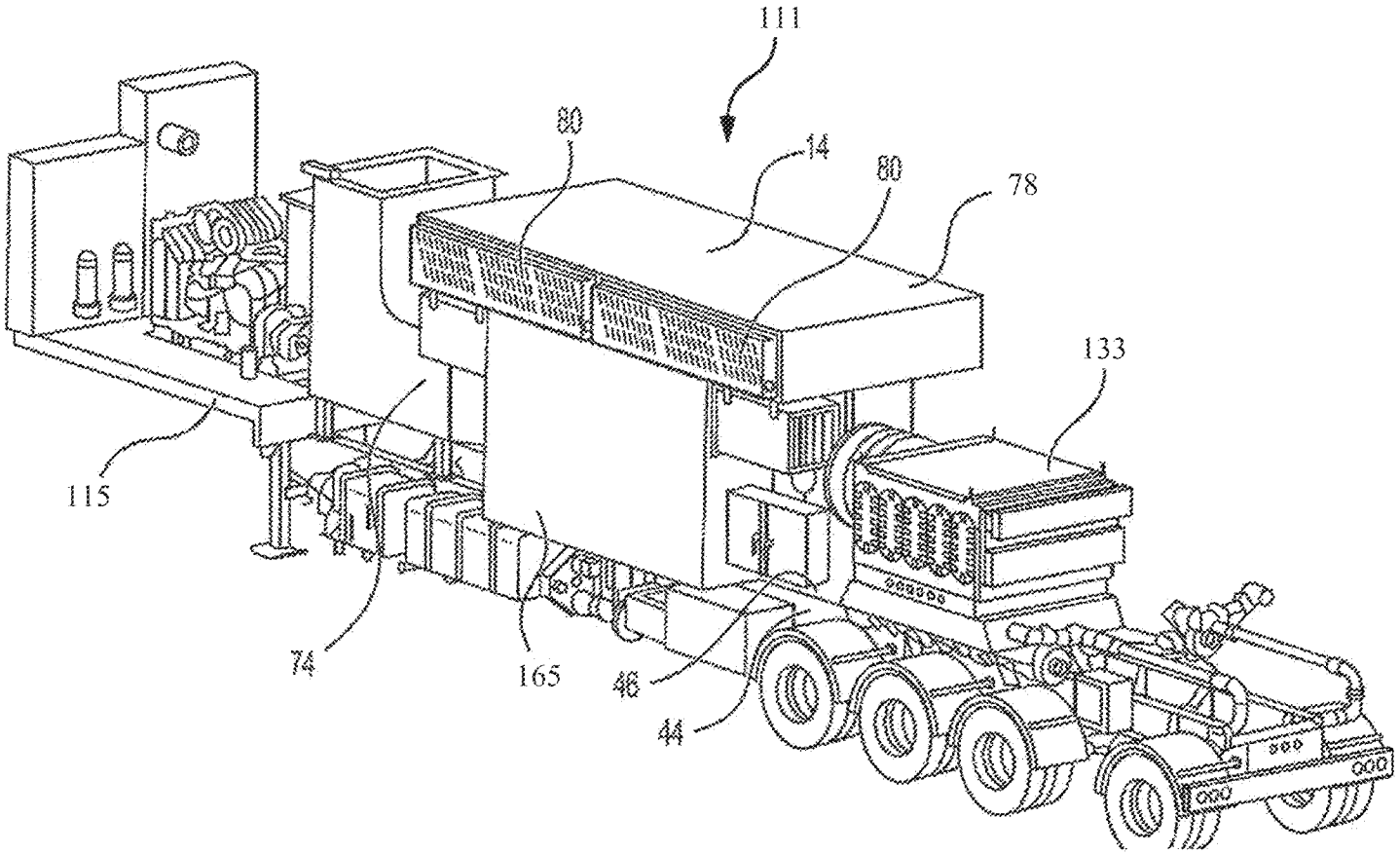
FIG. 7 is a schematic perspective view of an example pumping unit, according to embodiments of the disclosure.
Figure 8A:
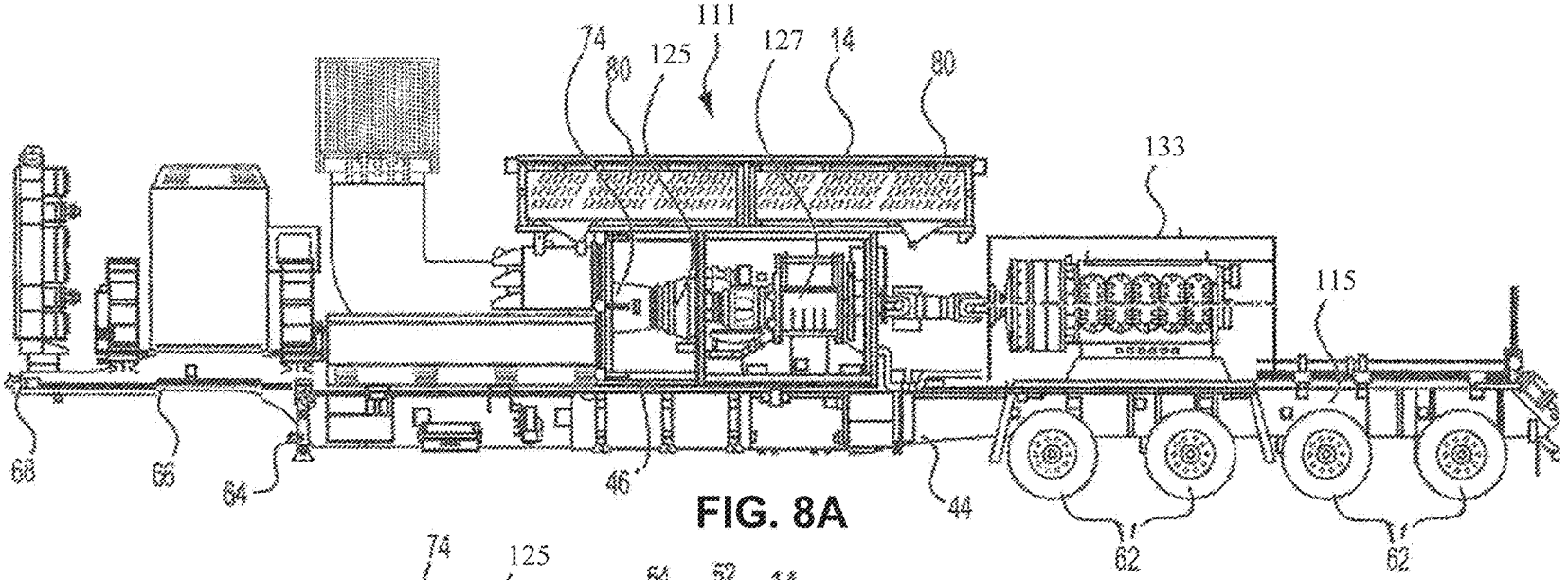
FIG. 8A is a schematic partial side section view of an example pumping unit, according to an embodiment of the disclosure.
Figure 8B:
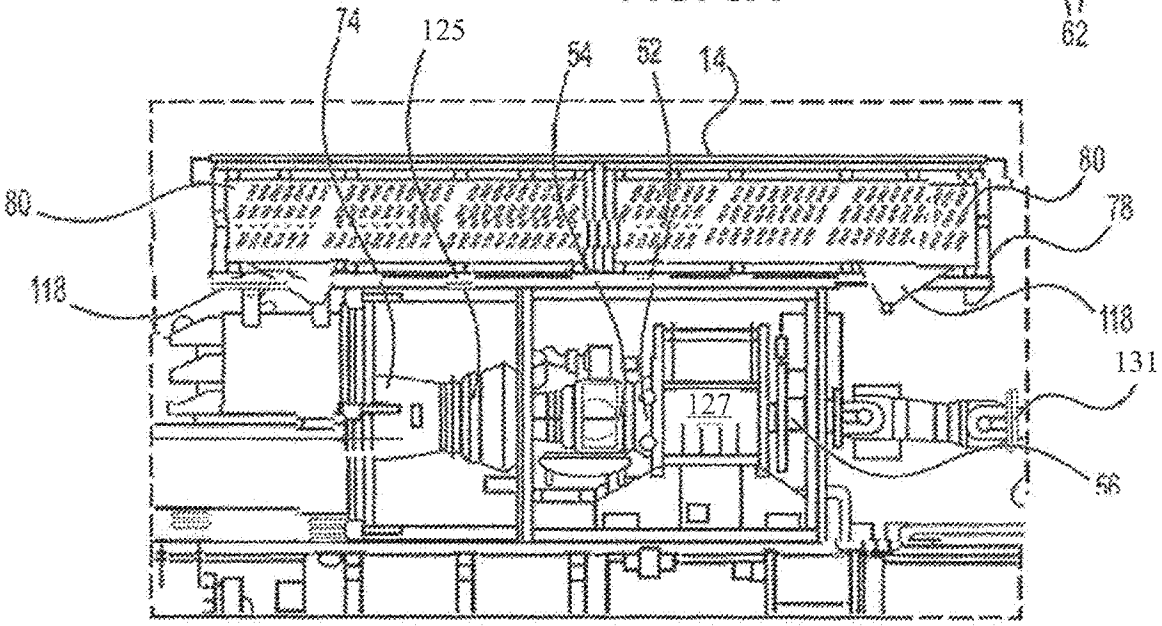
FIG. 8B is a schematic detailed partial side section view of the pumping unit of FIG. 8A and illustrates an example intake air treatment system with a filtration assembly for use with the example pumping unit shown in FIG. 7A, according to an embodiment of the disclosure.
Figure 8C:
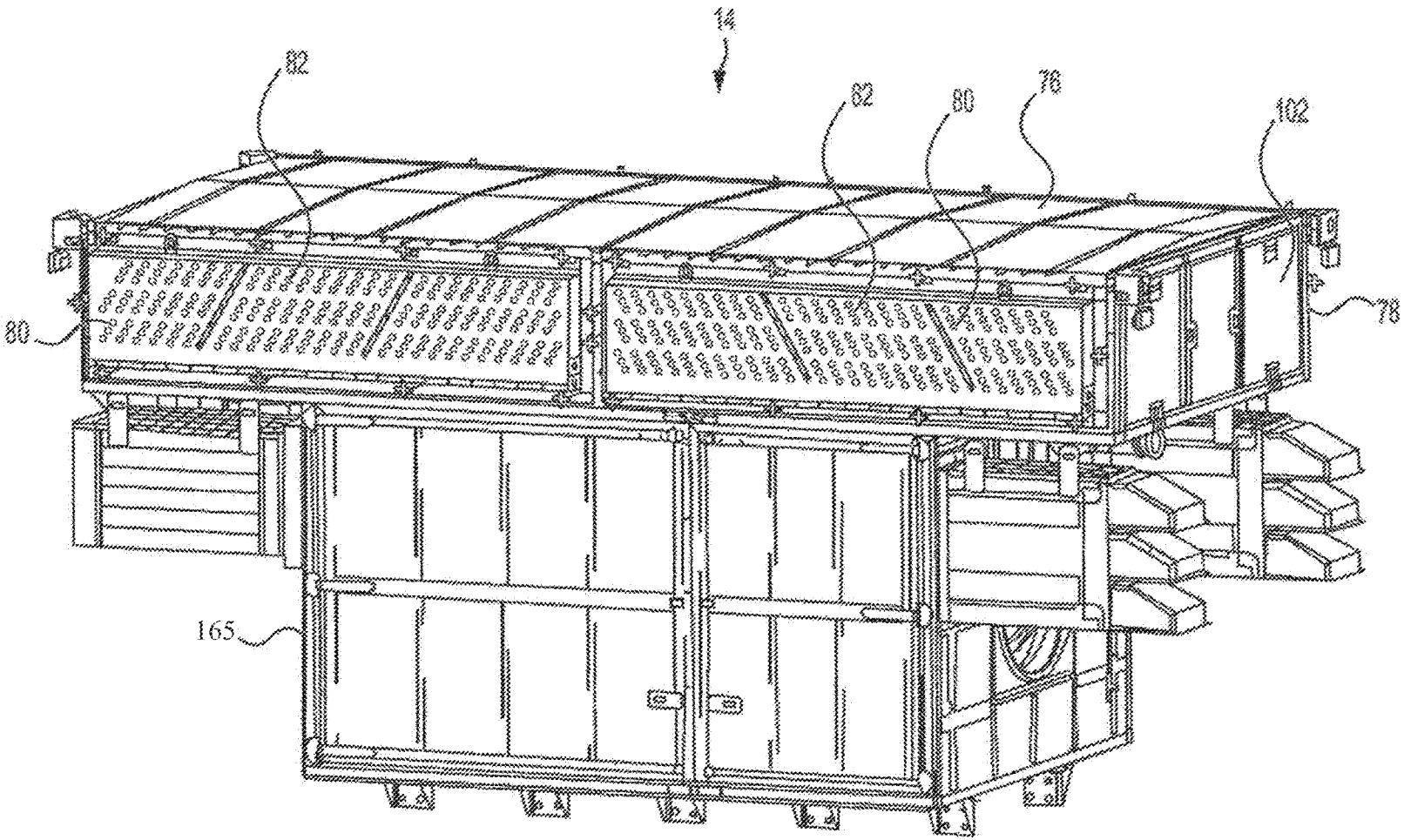
FIG. 8C is a schematic perspective view of the enclosure body and filtration assembly of the pumping unit of FIG. 8A, according to an embodiment of the disclosure.

FIG. 6 schematically illustrates a top view of an example hydraulic fracturing system 10 that can include one or more—optionally a plurality of—the present pumping units 111, according to embodiments of the disclosure. Pumping unit(s) 111 of hydraulic fracturing system 10 can be any of those described above, although each the pumping unit(s) of the embodiment shown is that depicted in FIGS. 7 and 8A-8C. FIGS. 7 and 8A are schematic perspective and partial side section views, respectively, of an example pumping unit 111, according to embodiments of the disclosure, FIG. 8B is a detailed partial side section view of the pumping unit and illustrates its example filtration assembly 14 above prime mover 125, according to embodiments of the disclosure, and FIG. 8C is a perspective view of the pumping unit's enclosure body 165 that is coupled to the filtration assembly. As explained herein, filtration assembly 14, in some embodiments, may be configured to enhance the efficiency of operation of a prime mover 125, such as a gas turbine engine (GTE), and can include an air intake assembly positioned to supply intake air to the prime mover.

As shown in FIGS. 8A and 8B and as noted above, in some embodiments, one or more of pumping units 111 may include a hydraulic fracturing pump 133 driven by prime mover 125 (e.g., GTE). In some embodiments, prime mover 125 may be a type of internal combustion engine other than a GTE, such as a reciprocating-piston engine (e.g., a diesel engine). In some embodiments, each of pumping unit(s) 111 may include a directly driven turbine (DDT) hydraulic fracturing pump 133, in which the hydraulic fracturing pump is connected to one or more GTEs 125 that supply power to the respective hydraulic fracturing pump for supplying fracturing fluid at high pressure and high flow rates to a formation. For example, as noted above, GTE 125 may be connected to a respective hydraulic fracturing pump 133 via a transmission 127 (e.g., a reduction gearbox) connected to a drive shaft, which, in turn, is connected to a driveshaft or input flange of the respective hydraulic fracturing pump, which may be a reciprocating hydraulic fracturing pump. Other types of engine to pump arrangements are contemplated as will be understood by those skilled in the art.

In some embodiments, for at least one—up to and including each—of pumping unit(s) 111, when prime mover 125 of the pumping unit is a GTE, the GTE may be a dual-fuel or bi-fuel GTE, for example, capable of being operated using of two or more different types of fuel, such as natural gas and diesel fuel, although other types of fuel are contemplated. For example, a dual-fuel or bi fuel GTE may be capable of being operated using a first type of fuel, a second type of fuel, and/or a combination of the first type of fuel and the second type of fuel. For example, the fuel may include gaseous fuels, such as, for example, compressed natural gas (CNG), natural gas, field gas, pipeline gas, methane, propane, butane, and/or liquid fuels, such as, for example, diesel fuel (e.g., #2 diesel), bio-diesel fuel, biofuel, alcohol, gasoline, gasohol, aviation fuel, and other fuels as will be understood by those skilled in the art. Gaseous fuels may be supplied by CNG bulk vessels, a gas compressor, a liquid natural gas vaporizer, line gas, and/or well-gas produced natural gas. Other types and associated fuel supply sources are contemplated. For at least one—up to and including each—of pumping unit(s) 111, prime mover 125 of the pumping unit may be operated to provide horsepower to drive transmission 127 connected to hydraulic fracturing pump 133 to fracture a formation during a well stimulation project or fracturing operation.

In some embodiments, the fracturing fluid may include, for example, water, proppants, and/or other additives, such as thickening agents and/or gels, such as guar. For example, proppants may include grains of sand, ceramic beads or spheres, shells, and/or other particulates, and may be added to the fracturing fluid, along with gelling agents to create a slurry as will be understood by those skilled in the art. The slurry may be forced via hydraulic fracturing pump(s) 133 into the formation at rates faster than can be accepted by the existing pores, fractures, faults, or other spaces within the formation. As a result, pressure in the formation may build rapidly to the point where the formation fails and begins to fracture. By continuing to pump the fracturing fluid into the formation, existing fractures in the formation may be caused to expand and extend in directions away from a well bore, thereby creating additional air flow paths for hydrocarbons to flow to the well. The proppants may serve to prevent the expanded fractures from closing or may reduce the extent to which the expanded fractures contract when pumping of the fracturing fluid is ceased. Once the well is fractured, large quantities of the injected fracturing fluid may be allowed to flow out of the well, and the water and any proppants not remaining in the expanded fractures may be separated from hydrocarbons produced by the well to protect downstream equipment from damage and corrosion. In some instances, the production stream of hydrocarbons may be processed to neutralize corrosive agents in the production stream resulting from the fracturing process.

In the example shown in FIG. 6, hydraulic fracturing system 10 may include one or more water tanks 24 for supplying water for fracturing fluid, one or more chemical additive units 26 for supplying gels or agents for adding to the fracturing fluid (e.g., guar, etc.), and one or more proppant tanks 28 (e.g., sand tanks) for supplying proppants for the fracturing fluid. The example hydraulic fracturing system 10 shown also includes a hydration unit 30 for mixing water from water tank(s) 24 and gels and/or agents from chemical additive unit(s) 26 to form a mixture, for example, gelled water. The example shown also includes a blender 32, which can be configured to receive water from water tank(s) 24 (e.g., after the water is mixed with gels and/or agents such that the blender receives the mixture from the hydration unit 30) and proppants via one or more conveyers 34 from the proppant tank(s) 28. Blender 32 may mix the mixture and the proppants into a slurry to serve as fracturing fluid for hydraulic fracturing system 10. Once combined, the slurry may be discharged through low pressure hoses, which convey the slurry into two or more low pressure lines in a fracturing manifold 36. In the example shown, the low pressure lines in fracturing manifold 36 may feed the slurry to the hydraulic fracturing pumps 133 through low-pressure suction hoses as will be understood by those skilled in the art.

Hydraulic fracturing pump(s) 133, driven by respective prime mover(s) 125 (e.g., GTE(s)), discharge the slurry (e.g., the fracturing fluid including the water, agents, gels, and/or proppants) at high flow rates and/or high pressures through individual high-pressure discharge lines into two or more high pressure flow lines, sometimes referred to as "missiles," on fracturing manifold 36. The flow from the high-pressure flow lines is combined at fracturing manifold 36, and one or more of the high-pressure flow lines provide fluid flow to a manifold assembly 38, sometimes referred to as a "goat head." Manifold assembly 38 delivers the slurry into a wellhead manifold 40. Wellhead manifold 40 may be configured to selectively divert the slurry to, for example, one or more wellheads 42 via operation of one or more valves. Once the fracturing process is ceased or completed, flow returning from the fractured formation discharges into a flowback manifold, and the returned flow may be collected in one or more flowback tanks as will be understood by those skilled in the art.

As schematically depicted in FIG. 6, FIG. 7, and FIG. 8A, one or more of the components of fracturing system 10 may be configured to be portable, so that the hydraulic fracturing system may be transported to a well site, quickly assembled, operated for a relatively short period of time, at least partially disassembled, and transported to another location of another well site for use. For example, for at least one—up to and including each—of pumping units 111, components of the pumping unit may be connected to and/or supported on a chassis 44, for example, a trailer and/or a support incorporated into a truck, so that they may be easily transported between well sites. In some embodiments, prime mover 125 (e.g., GTE), hydraulic fracturing pump 133, and/or transmission 127 may be connected to chassis 44. For example, chassis 44 may include a platform 46, transmission 127 may be connected to the platform, and prime mover 125 may be connected to the transmission. In some embodiments, prime mover 125 may be connected to transmission 127 without also connecting the prime mover directly to platform 46, which may result in fewer support structures being needed for supporting the prime mover, hydraulic fracturing pump 133, and/or transmission on chassis 44.

As shown in FIG. 6, some embodiments of hydraulic fracturing system 10 may include one or more fuel supplies 48 for supplying prime mover(s) 125 (e.g., GTE(s)) and any other fuel-powered components of the hydraulic fracturing system, such as auxiliary equipment, with fuel. Fuel supply(ies) 48 may include gaseous fuels, such as compressed natural gas (CNG), natural gas, field gas, pipeline gas, methane, propane, butane, and/or liquid fuels, such as, for example, diesel fuel (e.g., #2 diesel), bio-diesel fuel, biofuel, alcohol, gasoline, gasohol, aviation fuel, and other fuels as will be understood by those skilled in the art. Gaseous fuels may be supplied by CNG bulk vessels, such as fuel tanks coupled to trucks, a gas compressor, a liquid natural gas vaporizer, line gas, and/or well-gas produced natural gas. The fuel may be supplied to pumping unit(s) 111 by one of more fuel lines supplying the fuel to a fuel manifold and unit fuel lines between the fuel manifold and the hydraulic fracturing unit(s). Other types and associated fuel supply sources and arrangements are contemplated as will be understood by those skilled in the art.

As shown in FIG. 6, some embodiments also may include one or more data centers 50 configured to facilitate receipt and transmission of data communications related to operation of one or more of the components of the hydraulic fracturing system 10. Such data communications may be received and/or transmitted via hard-wired communications cables and/or wireless communications, for example, according to known communications protocols. For example, data center(s) 50 may contain at least some components of a hydraulic fracturing control assembly, such as a supervisory controller configured to receive signals from components of hydraulic fracturing system 10 and/or communicate control signals to components of the hydraulic fracturing system. The hydraulic fracturing control assembly may, for example, at least partially control operation of one or more components of hydraulic fracturing system 10, such as, for example, prime mover(s) 125 (e.g., GTE(s)), hydraulic fracturing pump(s) 133, and/or transmission(s) 127 of pumping unit(s) 111, chemical additive unit(s) 26, hydration unit(s) 30, blender 32, conveyer(s) 34, fracturing manifold 36, manifold assembly 38, wellhead manifold 40, and/or any associated valves, pumps, and/or other components of the hydraulic fracturing system.

As shown in FIGS. 8A and 8B, in some embodiments, transmission 127 may include a transmission input shaft 52 connected to a prime mover output shaft 54 (e.g., a turbine output shaft), such that the transmission input shaft rotates at the same rotational speed as the prime mover output shaft. Transmission 127 may also include a transmission output shaft 56 positioned to be driven by transmission input shaft 52 at a different rotational speed than the transmission input shaft. In some embodiments, transmission 127 may be a reduction gearbox, which results in transmission output shaft 56 having a relatively slower rotational speed than transmission input shaft 52. Transmission 127 may include a continuously variable transmission, an automatic transmission including one or more planetary gear trains, a transmission shiftable between different ratios of input-to-output, etc., or any other suitable of types of transmissions as will be understood by those skilled in the art.

As shown in FIGS. 8A and 8B, in some embodiments, hydraulic fracturing pump 133 may be, for example, a reciprocating fluid pump, as explained herein. In some embodiments, hydraulic fracturing pump 133 may include a pump driveshaft 131 connected to transmission output shaft 56, such that the transmission output shaft drives the pump driveshaft at a desired rotational speed. For example, transmission output shaft 56 may include an output shaft connection flange, and pump driveshaft 131 may include a driveshaft connection flange, and the output shaft connection flange and the driveshaft connection flange may be coupled to one another, for example, directly connected to one another. In some embodiments, transmission output shaft 56 and pump drive shaft 131 may be connected to one another via any known coupling types as will be understood by those skilled in the art (e.g., such as a universal joint and/or a torsional coupling).

As shown in FIGS. 7 and 8A and as noted above, in some embodiments, system 111—a pumping unit, in the shown embodiment, can comprise a trailer 115, and chassis 44 supporting components of the system may be or include the trailer. Trailer 115 can include a platform 46 for supporting components of system 111, one or more pairs of wheels 62 facilitating movement of the trailer, a pair of retractable supports 64 to support the system during use, and a tongue 66 including a coupler 68 for connecting the trailer to a truck for transport of the system, such as between well sites to be incorporated into a hydraulic fracturing system 10 of a well site fracturing operation, as will be understood by those skilled in the art.

As shown in FIGS. 7 and 8A-8C and as noted above, pumping unit 111 may include an enclosure body 165 configured to at least partially enclose prime mover 125 (e.g., GTE). Enclosure body 165 can also at least partially enclose the air intake assembly for prime mover 125, and pumping unit 111 can comprise a filtration assembly 14 having a filtration housing 78 coupled to the enclosure body. Enclosure body 165 may be positioned to facilitate the supply of intake air to the air intake assembly for prime mover 125. For example, enclosure body 165 can be disposed below filtration assembly 14, which can comprise pre-cleaners 80 that can include one or more inertial separators 82. Inertial separator(s) 82 can each be configured to separate a first portion of particles, liquids, and/or combinations thereof from the ambient air before the air enters an intake of prime mover 125, and the first portion of particles, liquids, and/or combinations thereof can fall and pass through a pre-cleaner bypass 118. Prime mover 125 can thus receive at least partially filtered intake air during operation.

Filtration assembly 14 can comprise sound attenuation baffles 76 arranged within or along filtration housing 78 (e.g., at the top of the filtration housing), and the filtration assembly may include one or more access panels 102 positioned to facilitate access to an intake air chamber of filtration assembly 14. For example, access panel(s) 102 may enable maintenance or replacement of filters and/or sound attenuation baffles 76, for example, if the intake air chamber houses the sound attenuation baffles.

Enclosure body 165 may be connected to and supported by chassis 44 according to embodiments of the disclosure. In some embodiments, as shown in FIGS. 8A and 8B, prime mover 125 may be connected to transmission 127 via prime mover output shaft 54 and transmission input shaft 52, both of which may be substantially contained within enclosure body 165. The air intake assembly may include an air intake duct and a turbine exhaust duct 74 passing through walls of enclosure body 165 and connected to prime mover 125. Prime mover 125 may be connected to hydraulic fracturing pump 133 via transmission 127, with the transmission output shaft 56 connected to the pump driveshaft 131, for example, as explained herein.

As shown in FIGS. 6, 7, 8A, and 8B, some embodiments of hydraulic fracturing pump 133 may have physical dimensions configured such that the hydraulic fracturing pump does not exceed the space available on the platform 46, for example, while still providing a desired pressure output and/or flow output to assist with performing the fracturing operation as explained herein. For example, hydraulic fracturing pump 133 may have a pump length dimension substantially parallel to a longitudinal axis of platform 46 that facilitates placement and/or connection of the hydraulic fracturing pump on the platform, for example, without causing pumping unit 111 to exceed a length permitted for transportation on public highways, for example, in compliance with government regulations.

In some embodiments, for example, as shown in FIG. 7, hydraulic fracturing pump 133 may have a pump width dimension substantially perpendicular to a longitudinal axis of platform 46 that facilitates placement and/or connection of the hydraulic fracturing pump on the platform 46, for example, without causing pumping unit 111 to exceed a width permitted for transportation on public highways, for example, in compliance with government regulations. For example, hydraulic fracturing pump 133 may have a pump width perpendicular to the longitudinal axis of platform 46, such that the pump width is less than or equal to the width of the platform, for example, as shown in FIG. 7.

As shown in FIG. 7, in some embodiments, as viewed from the rear of the platform 46 and in a direction substantially parallel to the longitudinal axis of the platform, an end of hydraulic fracturing pump 133 may take on the appearance of an inverted V-shaped architecture and may include two, four, six, eight, or more plungers that reciprocate in two banks of plungers in planes defining an angle therebetween, as will be understood by those skilled in the art. The defined angle may range, for example, from about 20 degrees to about 180 degrees (e.g., from about 30 degrees to about 120 degrees, about 90 degrees, about 70 degrees, about 60 degrees, or about 45 degrees). Hydraulic fracturing pumps having an in-line architecture and having two or more plungers (e.g., three, four, five, or more plungers) reciprocating in a common plane are contemplated.

Figure 9A:
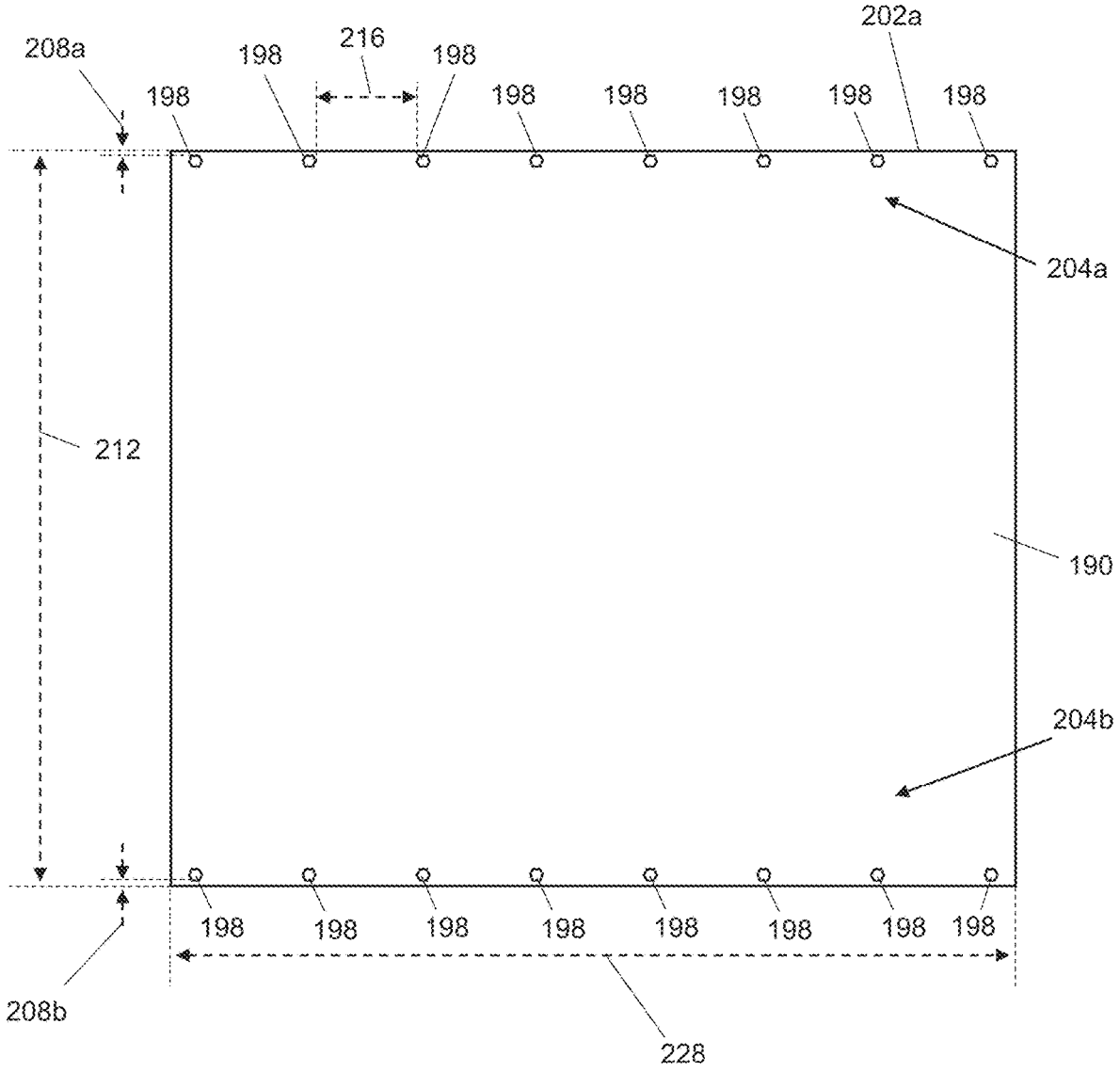
FIG. 9A is a schematic inside view of one of the present enclosure bodies and shows an anti-ballistic material attached to an inner surface of one of the walls of the enclosure body.
Figure 9B:
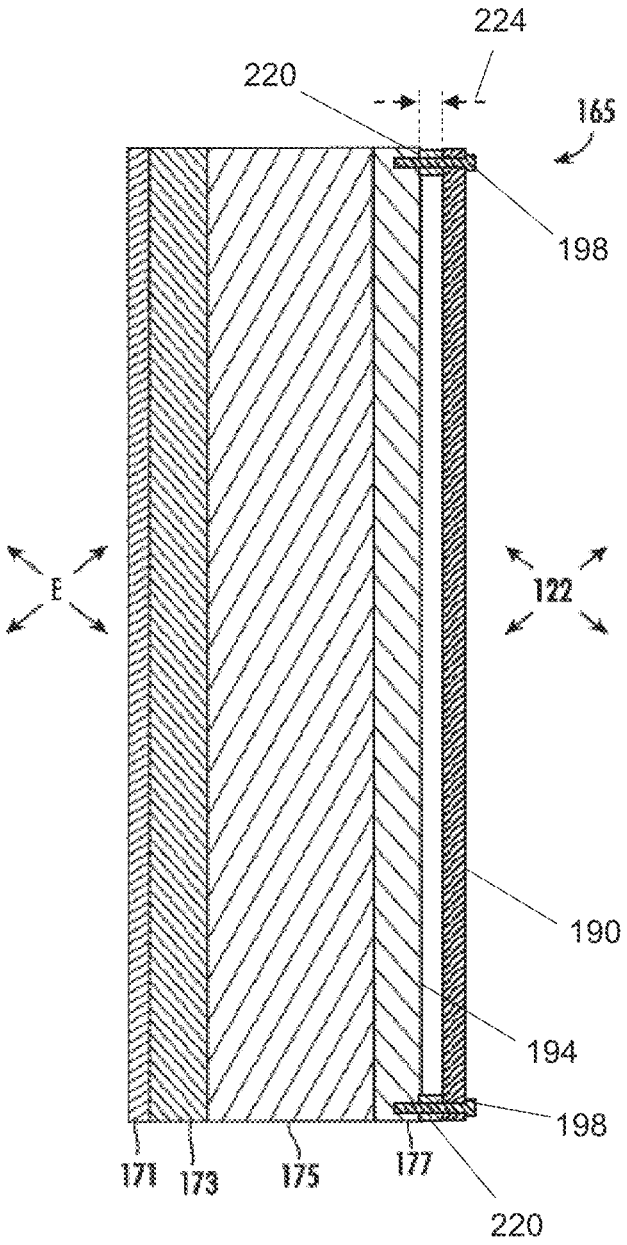
FIG. 9B is a schematic sectional view of the enclosure body of FIG. 9A.

Referring to FIGS. 9A and 9B, in one or more embodiments, the enclosures or cabins disclosed herein may contain or support one or more anti-ballistic materials 190. As used herein, the term "anti-ballistic material" means materials configured to deflect or absorb impact from projectiles such as shrapnel, gun-fire, or airborne debris. Each of anti-ballistic material(s) 190 may be formed from various materials including, without limitation, metals, metal alloys, stone materials, polymer materials, fiber or fabric materials (for instance, para-aramid fibers such as Kevlar® provided by E. I. du Pont de Nemours and Company of Wilmington, Del., United States), polycarbonate, and/or combinations thereof. In some embodiments, a metal alloy material may include steel or steel alloys (ST). Non-limiting examples of materials may include para-aramid fibers, ethylene vinyl acetate (EVA), polyethylene (PE), composites thereof, derivatives thereof, and/or any combinations thereof. In one or more embodiments, each of anti-ballistic material(s) 190 includes para-aramid fibers such as Kevlar.

Each of anti-ballistic material(s) 190 may be in any suitable form. For example, each of anti-ballistic material(s) 190 may be in the form of woven or non-woven fabric. In some embodiments, each of anti-ballistic material(s) 190 is in the form of a woven fabric that comprises fibers such as para-aramid fibers, which can promote the anti-ballistic material's ability to catch debris projected from prime mover 125 when, for example, the prime mover experiences a catastrophic failure.

In one or more embodiments, anti-ballistic material(s) 190 may each be attached to, connected to, or otherwise disposed on one or more of the walls (e.g., sidewalls 167 and 169, front and rear walls 171 and 173, roof/top wall 166, floor/bottom wall 168) and/or door(s) 179, 181, 189A-189E of enclosure body 165 (e.g., of the enclosure body described with reference to FIGS. 1A-5 or of the enclosure body described with reference to FIGS. 6-8C).

Anti-ballistic material(s) 190 may each be connected to one or more of the walls and/or doors of enclosure body 165 in any suitable manner. In one or more embodiments, each of anti-ballistic material(s) 190 may be connected to inner surface 194 of at least one of the walls and/or doors of enclosure body 165. In some embodiments, at least one of the walls of enclosure body 165 has the protection of one or more of anti-ballistic material(s) 190, such as where for at least one—or up to and including each—of the walls of the enclosure body (e.g., for at least one—or up to and including each—of sidewalls 167 and 169 and front and rear walls 171 and 173), at least one of the anti-ballistic material(s) is attached to inner surface 194 of the wall. For example, anti-ballistic material(s) 190 may each be in the form of a fabric that is attached to and/or suspended adjacent to one of inner surfaces 194 of enclosure body 165. In one or more embodiments, anti-ballistic material(s) 190 may each be disposed within one or more of the walls and/or one or more of the doors of enclosure body 165. In alternative embodiments, anti-ballistic material(s) 190 may each be attached to and/or suspended adjacent to the outer surface of one or more of the walls and/or one or more of the doors of enclosure body 165. In one or more embodiments, the anti-ballistic material(s) 190 may be attached to and/or suspended adjacent to the inner surfaces and/or outer surfaces of the one or more walls and/or the one or more doors such that a length and width of the anti-ballistic material(s) 190 run alongside and parallel (or substantially parallel) to a length and width of the wall or door adjacent to the anti-ballistic material 190.

Anti-ballistic material(s) 190 may be attached to and/or suspended from one or more of inner surfaces 194 of the walls and/or doors of enclosure body 165 in any suitable manner. For example, anti-ballistic material(s) 190 may be bolted or otherwise fastened to one or more of inner surfaces 194 of the walls and/or doors of enclosure body 165, e.g., such that for each of the anti-ballistic material(s) that is attached to the inner surface 194 of at least one of the walls and/or doors of the enclosure body, the anti-ballistic material is attached to the inner surface via a plurality of fasteners 198 (e.g., bolts). As shown, for each of such anti-ballistic material(s) 190, the anti-ballistic material can have opposing upper and lower edges 202*a* and 202*b* and fasteners 198 attaching the anti-ballistic material to inner surface 194 can include a first set 204*a* of fasteners positioned relatively close to the upper edge and a second set 204*b* of fasteners positioned relatively closer to the lower edge. For example, a distance 208*a* between each of fasteners 198 of first set 204*a* and upper edge 202*a* can be less than or equal to any one of, or between any two of, 10%, 9%, 8%, 7%, 6%, 5%, 4%, 3%, 2%, or 1% of a height 212 of anti-ballistic material 190, measured between the upper edge and lower edge 202*b* thereof, such as less than or equal to any one of, or between any two of, 5, 4, 3, 2, or 1 inches. Likewise, a distance 208*b* between each of fasteners 198 of second set 204*b* and upper lower edge 202*b* can be less than or equal to any one of, or between any two of, 10%, 9%, 8%, 7%, 6%, 5%, 4%, 3%, 2%, or 1% of height 212 of anti-ballistic material 190, such as less than or equal to any one of, or between any two of, 5, 4, 3, 2, or 1 inches. Such fastener positioning can promote anti-ballistic material 190's ability to contain debris from prime mover 125. To furthermore promote secure attachment, for each of fasteners 198, a distance 216, measured in a direction that is substantially parallel to a width 228 of anti-ballistic material 190, between the fastener and at least one other of the fasteners can be less than or equal to any one of, or between any two of, 20%, 19%, 18%, 17%, 16%, 15%, 14%, 13%, 12%, 11%, or 10% of the anti-ballistic material's width, such as less than or equal to any one of, or between any two of, 20, 19, 18, 17, 16, 15, 14, 13, 12, 11, or 10 inches. With such spacing, first and second sets 204*a* and 204*b* of fasteners 198 can each include greater than or equal to any one of, or between any two of, 5, 6, 7, 8, 9, or 10 fasteners.

In one or more embodiments, for each anti-ballistic material(s) 190 that is attached to and/or suspended from inner surface 194 of at least one of the walls and/or doors of enclosure body 165, the anti-ballistic material can be positioned such that there is a space between the inner surface and the anti-ballistic materials. For example, for each of anti-ballistic material(s) 190 that is attached to inner surface 194 of at least one of the walls and/or doors of enclosure body 165 via fasteners 198, for each of the fasteners system 111 (e.g., the pumping unit) can include a spacer 220 that the fastener extends through and is disposed between the anti-ballistic material and the inner surface to which the anti-ballistic material is attached, which can position the anti-ballistic material away from the inner surface. A distance 224 between anti-ballistic material 190 and inner surface 194 of the wall and/or door to which the anti-ballistic material is attached can be greater than or equal to any one of, or between any two of, 1, 3, 5, 10, 20, or 30 millimeters (e.g., from 1, 3, or 5 millimeters to 10, 20, or 30 millimeters). The spacing between inner surface 194 and anti-ballistic material 190 can further promote the anti-ballistic material's ability to contain debris projected from prime mover 125 (e.g., in the event of catastrophic failure).

Anti-ballistic material(s) 190 can have any suitable size to facilitate their protection of the walls and/or doors of enclosure body 165. For example, height 212 and width 228 of each of anti-ballistic material(s) 190 can be about the same as that of the wall or door to which the anti-ballistic material is attached. As an illustration, for each of anti-ballistic material(s) 190 attached to one of the walls, height 212 can be greater than or equal to any one of, or between any two of, 50, 55, 60, 65, 70, 75, or 80 inches and width 228 can be greater than or equal to any one of, or between any two of, 60, 65, 70, 75, 80, 85, 90, 95, 100, 105, 110, 115, 120, 125, or 130 inches.

In some embodiments, enclosure assembly 121 for prime mover 125 may provide for enhanced cooling by the configuration and arrangement of one or more heat exchangers that cool one or more process fluids associated with the prime mover and/or an associated fluid pumping system while also providing ventilation and cooling of an enclosure space 122 within the enclosure assembly. In addition to the enhanced cooling of prime mover 125 provided by such an arrangement, the footprint of enclosure assembly 121 may be minimized and the management of associated power systems may be streamlined.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the apparatuses, systems, and methods are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A hydraulic fracturing system comprising:
- one or more water tanks;
- one or more proppant tanks;
- a blender configured to receive water from the water tank(s) and proppant from the proppant tank(s); and
- one or more pumping units, each comprising:
  - a hydraulic fracturing pump that is in fluid communication with:
    - the blender; and
    - one or more wellheads;
  - a prime mover configured to drive the hydraulic fracturing pump; and
  - an enclosure that includes:
    - a body that comprises walls; and
    - one or more anti-ballistic materials;
    - wherein:
      - the prime mover is housed in the body of the enclosure; and
      - for at least one of the walls of the body of the enclosure, at least one of the anti-ballistic material(s) is attached to an inner surface of the wall.

2. The hydraulic fracturing system of claim 1, wherein for each of the pumping unit(s), each of the anti-ballistic material(s) is in the form of a woven fabric that comprises para-aramid fibers.

3. The hydraulic fracturing system of claim 2, wherein for each of the pumping unit(s), the walls of the body of the enclosure include:
- opposing first and second sidewalls; and
- opposing front and rear walls, each extending from the first sidewall to the second sidewall;
- wherein for each of the first and second sidewalls and front and rear walls, at least one of the anti-ballistic material(s) is attached to the inner surface of the wall.

4. The hydraulic fracturing system of claim 3, wherein for each of the pumping unit(s), the first and second sidewalls and front and rear walls each comprise a metal.

5. The hydraulic fracturing system of claim 3, wherein for each of the pumping unit(s), the first and second sidewalls and front and rear walls each include multiple layers, the layers including:
- inner and outer metallic layers; and
- a foam layer and/or a mineral wool layer that are each disposed between the inner and outer metallic layers.

6. The hydraulic fracturing system of claim 5, wherein the first and second sidewalls and front and rear walls each have a thickness that is between 4.5 and 5.25 inches.

7. The hydraulic fracturing system of claim 5, wherein for each of the pumping unit(s):

the prime mover comprises a gas turbine engine that is in fluid communication with at least one fuel supply;

the pumping unit comprises a gearbox that:

is operatively connected to the prime mover; and is housed in the body of the enclosure; and the hydraulic fracturing pump is disposed outside of the body of the enclosure and is operatively connected to the gearbox via a driveshaft.

8. The hydraulic fracturing system of claim 1, wherein for each of the pumping unit(s), for each of the anti-ballistic material(s) that is attached to the inner surface of at least one of the walls of the body of the enclosure, a distance between the anti-ballistic material and the inner surface to which the anti-ballistic material is attached is at least 1 millimeter.

9. The hydraulic fracturing system of claim 8, wherein for each of the pumping unit(s), for each of the anti-ballistic material(s) that is attached to the inner surface of at least one of the walls of the body of the enclosure:

the anti-ballistic material is attached to the inner surface via a plurality of fasteners, wherein for each of the fasteners the pumping unit includes a spacer that:

the fastener extends through; and is disposed between the anti-ballistic material and the inner surface to which the anti-ballistic material is attached.

10. The hydraulic fracturing system of claim 9, wherein for each of the pumping unit(s), for each of the anti-ballistic material(s) that is attached to the inner surface of at least one of the walls of the body of the enclosure:

the anti-ballistic material has:

opposing upper and lower edges; and a height measured between the upper and lower edges; and the fasteners include:

a first set of fasteners, wherein for each of the fasteners of the first set, a distance between the fastener and the upper edge of the anti-ballistic material is within 10% of the height of the anti-ballistic material; and a second set of fasteners, wherein for each of the fasteners of the second set, a distance between the fastener and the lower edge of the anti-ballistic material is within 10% of the height of the anti-ballistic material.

11. A system comprising:

a prime mover configured to drive:

a hydraulic fracturing pump; or an electric power generator; and an enclosure that includes:

a body that comprises walls; and one or more anti-ballistic materials;

wherein:

the prime mover is housed in the body of the enclosure; and for at least one of the walls of the body of the enclosure, at least one of the anti-ballistic material(s) is attached to an inner surface of the wall.

12. The system of claim 11, wherein each of the anti-ballistic material(s) is in the form of a woven fabric that comprises para-aramid fibers.

13. The system of claim 12, wherein the walls of the body of the enclosure include:

opposing first and second sidewalls; and opposing front and rear walls, each extending from the first sidewall to the second sidewall;

wherein for each of the first and second sidewalls and front and rear walls, at least one of the anti-ballistic material(s) is attached to the inner surface of the wall.

14. The system of claim 13, wherein the first and second sidewalls and front and rear walls each comprise a metal.

15. The system of claim 13, wherein the first and second sidewalls and front and rear walls each include multiple layers, the layers including:

inner and outer metallic layers; and a foam layer and/or a mineral wool layer that are each disposed between the inner and outer metallic layers.

16. The system of claim 15, wherein the first and second sidewalls and front and rear walls each have a thickness that is between 4.5 and 5.25 inches.

17. The system of claim 15, wherein:

the prime mover comprises a gas turbine engine;

the system comprises a gearbox that:

is operatively connected to the prime mover; and is housed in the body of the enclosure; and the hydraulic fracturing pump or electric power generator is disposed outside of the body of the enclosure and is operatively connected to the gearbox via a driveshaft.

18. The system of claim 11, wherein for each of the anti-ballistic material(s) that is attached to the inner surface of at least one of the walls of the body of the enclosure, a distance between the anti-ballistic material and the inner surface to which the anti-ballistic material is attached is at least 1 millimeter.

19. The system of claim 18, wherein for each of the anti-ballistic material(s) that is attached to the inner surface of at least one of the walls of the body of the enclosure:

the anti-ballistic material is attached to the inner surface via a plurality of fasteners, wherein for each of the fasteners the system includes a spacer that:

the fastener extends through; and is disposed between the anti-ballistic material and the inner surface to which the anti-ballistic material is attached.

20. The system of claim 19, wherein for each of the anti-ballistic material(s) that is attached to the inner surface of at least one of the walls of the body of the enclosure:

the anti-ballistic material has:

opposing upper and lower edges; and a height measured between the upper and lower edges; and the fasteners include:

a first set of fasteners, wherein for each of the fasteners of the first set, a distance between the fastener and the upper edge of the anti-ballistic material is within 10% of the height of the anti-ballistic material; and a second set of fasteners, wherein for each of the fasteners of the second set, a distance between the fastener and the lower edge of the anti-ballistic material is within 10% of the height of the anti-ballistic material.

* * * * *